US007347400B2

(12) United States Patent
Thurner et al.

(10) Patent No.: US 7,347,400 B2
(45) Date of Patent: Mar. 25, 2008

(54) STAND FOR CLAMPING A ROD-SHAPED UNIT, PARTICULARLY A CHRISTMAS TREE

(75) Inventors: Gunther Thurner, Strasskirchen (DE); Martin Thurner, Strasskirchen (DE)

(73) Assignee: Krinner Innovation GmbH (DE)

( * ) Notice: Subject to any disclaimer, the term of this patent is extended or adjusted under 35 U.S.C. 154(b) by 0 days.

(21) Appl. No.: 11/723,177

(22) Filed: Mar. 16, 2007

(65) Prior Publication Data

US 2007/0257179 A1 Nov. 8, 2007

(30) Foreign Application Priority Data

Mar. 17, 2006 (DE) ..... 10 2006 012 425

(51) Int. Cl.
*F16M 13/00* (2006.01)

(52) U.S. Cl. ..... 245/525; 248/519; 248/523

(58) Field of Classification Search ..... 248/525, 248/523, 519, 524, 527; 47/40.5, 44.11
See application file for complete search history.

(56) References Cited

U.S. PATENT DOCUMENTS

| | | | | |
|---|---|---|---|---|
| 5,114,113 | A * | 5/1992 | Krinner | 248/525 |
| 5,707,037 | A * | 1/1998 | Pastrick | 248/516 |
| 6,012,698 | A * | 1/2000 | Hardt et al. | 248/523 |
| 6,019,341 | A * | 2/2000 | Brown et al. | 248/516 |
| 6,283,436 | B1 * | 9/2001 | Schulz et al. | 248/523 |
| 6,854,700 | B2 * | 2/2005 | Schmitz | 248/523 |
| 6,877,708 | B1 * | 4/2005 | Thurner | 248/519 |
| 6,988,702 | B2 * | 1/2006 | Schulz | 248/525 |

FOREIGN PATENT DOCUMENTS

| | | |
|---|---|---|
| DE | 39 32 473 | 2/1992 |
| DE | 201 05 005 | 8/2001 |
| DE | 102 20 879 | 8/2003 |
| DE | 203 20 092 | 6/2004 |

* cited by examiner

*Primary Examiner*—Amy J. Sterling
(74) *Attorney, Agent, or Firm*—Davidson Berquist Jackson & Gowdey LLP

(57) ABSTRACT

A stand for holding a rod-shaped unit, particularly a Christmas tree, comprises a foot part, a seating region for the tree trunk, said seating region being located on the foot part, several holding elements, which are supported around an axis of symmetry of the stand and which are pivotable against spring force out of an open position into a holding position, their pivoting planes intersecting approximately in the axis of symmetry, and at least one flexible force transfer element, particularly a steel cable, which can be actuated by means of a tensioning device and which can be loaded in tension and which engages around the holding elements and which, when tightened, causes the holding elements to pivot towards the axis of symmetry into the holding position. The holding elements comprise an upper dimensionally rigid holding region for transferring the tension and holding forces and a resilient element, which is fixed or is molded on below said holding region and by means of which the respective holding element is held in a receptacle, the holding element and its receptacle being designed such that the holding element is pivotable out of the open position into the holding position, that it is guided in its receptacle in this pivoting movement and that it simultaneously provides the spring force counteracting the pivoting movement.

12 Claims, 5 Drawing Sheets

STAND FOR CLAMPING A ROD-SHAPED UNIT, PARTICULARLY A CHRISTMAS TREE

CROSS-REFERENCE TO RELATED APPLICATIONS

Figure 1:
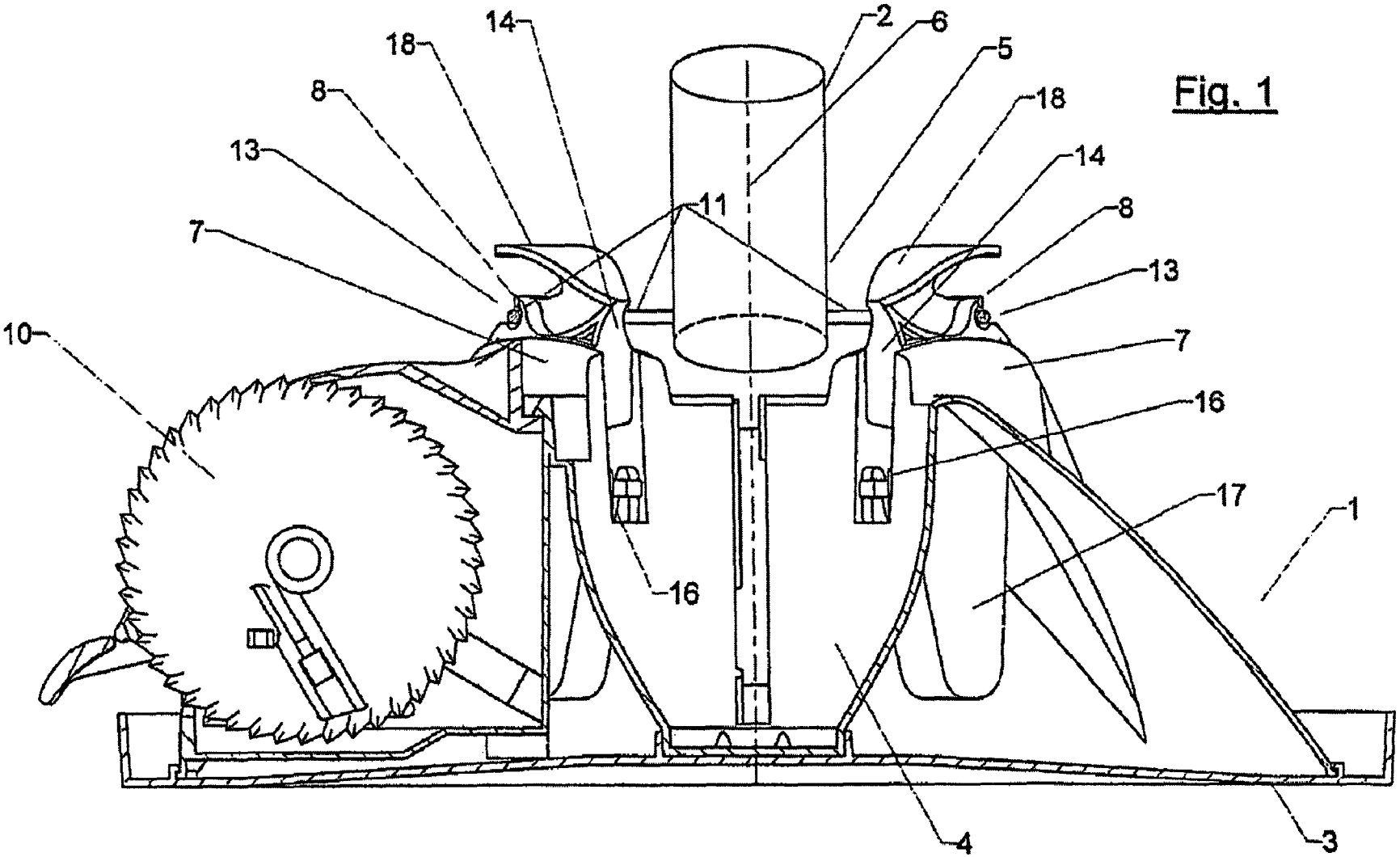

This application claims priority to German Application No. DE 10 2006 012 425.1 filed Mar. 17, 2006, the entire contents of which are herein incorporated by reference. The present invention is also related to U.S. patent application Ser. No. 11/723,130, entitled "Tensioning Device For Use At A Stand For Clamping A Rod-Shaped Unit, Particularly A Christmas Tree, And A Stand With A Tensioning Device," filed on even date herewith, the entire contents of each of which are incorporated herein by reference.

The present invention relates to a stand for clamping a rod-shaped unit, particularly a Christmas tree according to the preamble of claim 1.

Stands for clamping rod-shaped units, Christmas trees in particular, are known from the prior art in various embodiments. Particularly those stands are also known in which pivotable holding elements are pivoted by one or more flexible force transfer elements, which can be loaded in tension and thus made to engage around the Christmas tree by clamping it. The flexible force transfer element is usually a steel cable or it consists of several steel cables. It is guided such that it slides through guide openings located in the holding elements mostly above the pivot axes of the latter. The effective length of the at least one steel cable is shortened by a tensioning device located on the stand with the result that the holding elements are pivoted inwardly in the sense of resting against the rod-shaped unit.

Examples of this are disclosed in DE 39 32 473 C2, DE 102 20 879 A1, DE 39 32 432 C2 and DE 201 05 005 U1. Here, a single steel cable is guided in the form of a closed loop through all the holding elements and supplied to the winding roller of the tensioning device. The pivotable holding elements are arranged circularly or annularly around an axis of symmetry of the stand, which axis of symmetry simultaneously forms the longitudinal axis of the rod-shaped unit to be clamped.

The above-mentioned stands known from the prior art have proved to be of value in practice. However, their production is relatively cumbersome since they are composed of a plurality of partially very complex components in addition to different materials, such as for example, plastic components for foot part, seating region, and also a cover on the one hand and steel components such as pivot axes, pivoted levers, holding plates, holding claws, springs, rivets, screws, catches, ratchets, steel cables etc. on the other. These individual parts are standard products only to some extent. Furthermore, they are custom-made products for special stands, which are required in very limited quantities, thereby adversely affecting the production costs of the stands. Incidentally, the complexity of the construction also makes these stands susceptible to failures, e.g. caused by contamination or wear.

This results in the objective of improving a stand of the type mentioned in the introduction in such a way that it can be produced more inexpensively by reducing the number of components required for its production, at the same time replacing expensive steel components with much more inexpensive plastic and reducing the amount of effort for the assembly as far as possible and facilitating any necessary repair of the stand.

This objective is attained by a stand having the features set forth in claim 1. Expedient refinements of the present invention are defined in the subordinate clauses.

The stand according to the present invention comprises a foot part having a seating region for the fixing end of a rod-shaped unit, for example, a Christmas tree, said seating region being located on the foot part, with several holding elements arranged about the axis of symmetry of the stand.

These holding elements are held in bearing blocks, which are arranged on the foot part or are designed as integral components of the molded part used as the foot part or as integral components of a surface-mounted part fixed preferably on the foot part.

The holding elements can be pivoted against spring force out of an open position into a holding position each time in a pivoting plane, the pivoting planes intersecting approximately in the axis of symmetry of the stand.

The holding elements are brought out of the open position into the holding position by at least one flexible force transfer element, for example one or also more steel cables, which can be actuated by means of the tensioning device, and which can be loaded in tension, wherein in the so-called multi-cable technology every force transfer element engages at least one holding element. This takes place due to the fact that the force transfer element engages around the holding elements above their pivot axes while being guided so as to slide in a transversely moveable manner in guide openings of the holding elements with the result that when the force transfer element (cable) is tightened and consequently shortened, the holding elements are pivoted towards the axis of symmetry of the stand into the holding position.

The upper regions of the holding elements, in which region the tension forces of the cable and the holding forces engage, consist of a dimensionally rigid holding region, which, during the clamping action, comes to rest against and hold on to the rod-shaped unit. Connected below this holding region is a downwardly extending resilient element, which can be fixed to the holding region or preferably formed with the holding region as a single piece and by means of which the respective holding element can be supported in the respective bearing block.

Preferably the resilient element is designed and supported in the bearing block in such a way that the holding element cannot pivot about a fixed pivot axis, i.e. it has an imaginary moving pivot axis. The distance by which the pivot axis moves depends on the angle around which the holding element is pivoted.

The resilient element can be designed not only as a simple downwardly extending component, but rather as a V-shaped upwardly open leaf spring whose one leg is attached or preferably molded on to the holding region of the holding element and whose other free leg points upwards towards the axis of symmetry of the stand. In an appropriate design of the receptacles for the holding elements, this construction helps achieve a particularly good guidance between the respective holding element and its receptacle and the bearing of said holding element in its receptacle.

Particularly, in the case of a single-piece design of the holding element and the resilient element, there results another essential advantage that the holding elements can be produced as simple injection-molded parts, for example, from a suitable plastic of sufficient strength.

The resilient element is preferably designed to have a cross-section that changes in its longitudinal direction such that the resilient element or the spring is a carrier having substantially constant bending tension.

The holding elements can be supported by being merely inserted into the respective bearing block intended for this purpose and correspondingly shaped recesses or receptacles. In this case, they are held in their seats preferably by the cable engaging around them, or in certain circumstances, by providing them with a shape that ensures a form locking. However, a locking mechanism preferably with a trailing cam can also be provided preferably on the free end of the resilient elements.

The holding elements and their receptacles in the respective bearing block are designed such that the holding elements in the bearing block can pivot out of the open position into the holding position during the tightening of the cable. To this end, the holding elements with their resilient elements are supported in the receptacles such that the holding elements can laterally pivot about the moving pivot axis.

This can occur, for example, in the case of a resilient element extending downwardly into the receptacle such that it is mounted, possibly also locked with its lower end in the base of the receptacle while it can move freely above this mounting towards the axis of symmetry.

When designing the resilient element as an upwardly open V, there is no requirement of any such special mounting in the base of the receptacle. In a corresponding form of the receptacle, the V nestles over its entire surface against the walls of the receptacle without the pivoting movement becoming consequently lost in the radial direction, i.e. towards the axis of symmetry.

In any case, deviating from the prior art in this regard, this design dispenses with a physical pivot axis for the holding elements, which pivot axis would complicate the assembly. The pivot axis 12 of the holding elements is thus to be understood only as an ideal axis, which additionally does not have a fixed position.

In order to ensure a sufficient lateral guidance of the holding elements in their pivoting movement during the clamping action, and in order to support the holding regions simultaneously in their holding function in the holding position, in spite of the absence of a physical pivot axis in the guidance, guidance surfaces for guiding the pivoting movement are designed on the holding elements and on the bearing blocks, said guidance surfaces corresponding to one another and being parallel to the pivoting plane of the respective holding element. In order to ensure the best guidance possible, these guidance surfaces extend over the entire length and width of the holding elements including the resilient regions and the dimensionally rigid holding region, if the latter does not protrude from the receptacle.

The holding element thus designed further sets itself apart advantageously from the prior art explained above by simultaneously providing the spring force counteracting the pivoting movement without having to provide and mount internal components during assembly for this purpose, for example, one tension spring for each holding element.

The holding elements thus designed can be optimized for improving the functioning of the stand by molding guidance surfaces above the dimensionally rigid holding regions of the holding elements, said guidance surfaces being inclined downwardly towards the axis of symmetry of the stand and being provided for facilitating the introduction of the rod-shaped unit.

On the whole, the result is thus a stand which manages with a greatly reduced number of simply structured components, which are additionally easily producible, can be produced particularly easily in an inexpensive injection molding process and can be mounted or demounted and thus replaced just as easily.

Preferably a foot-operable drive wheel serves as a tensioning device for the at least one force transfer element which drive wheel uses a safety catch to enable a clamping action in a holding position and an automatic reverse rotation into a release position.

Figure 2:
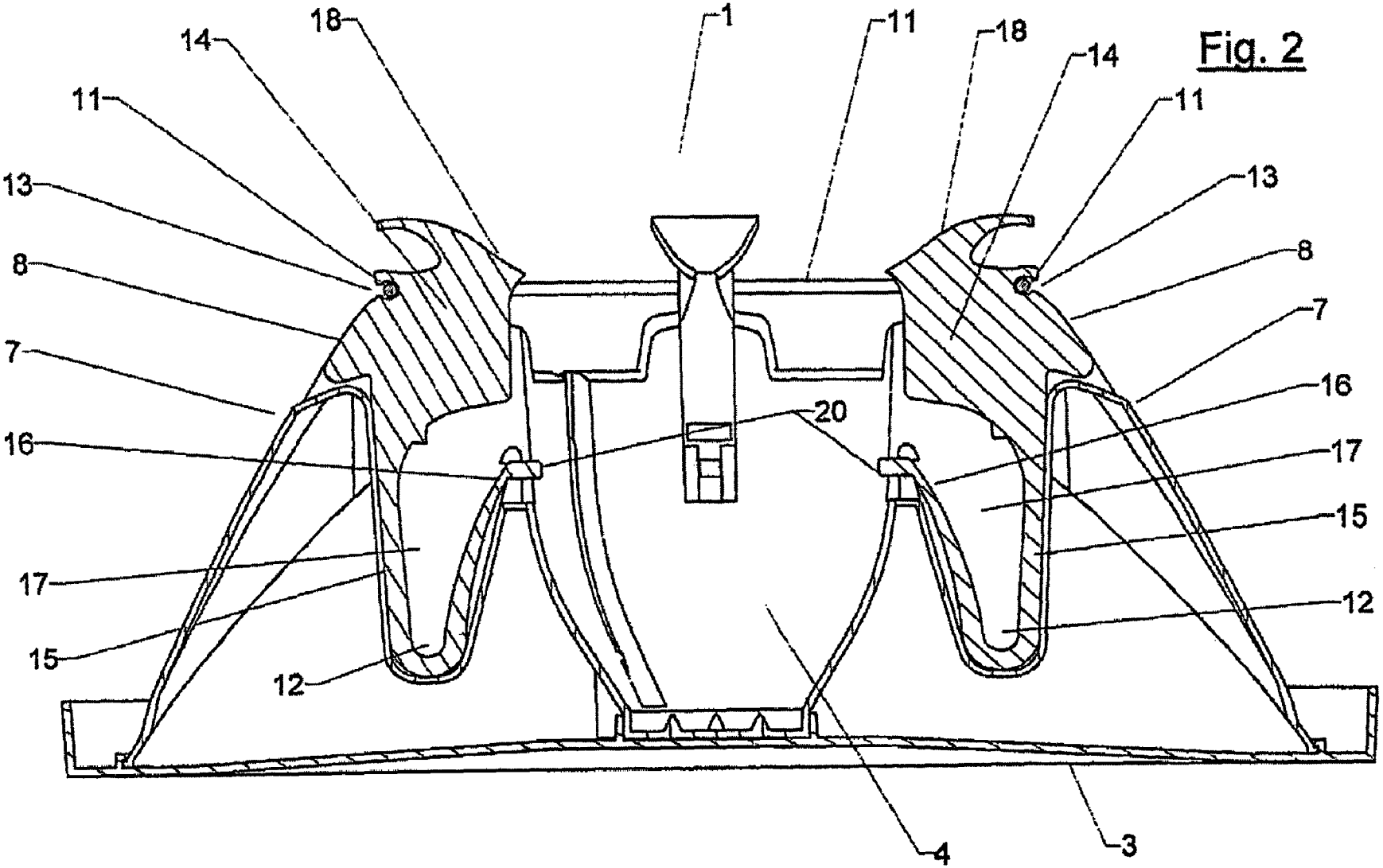
Figure 3:
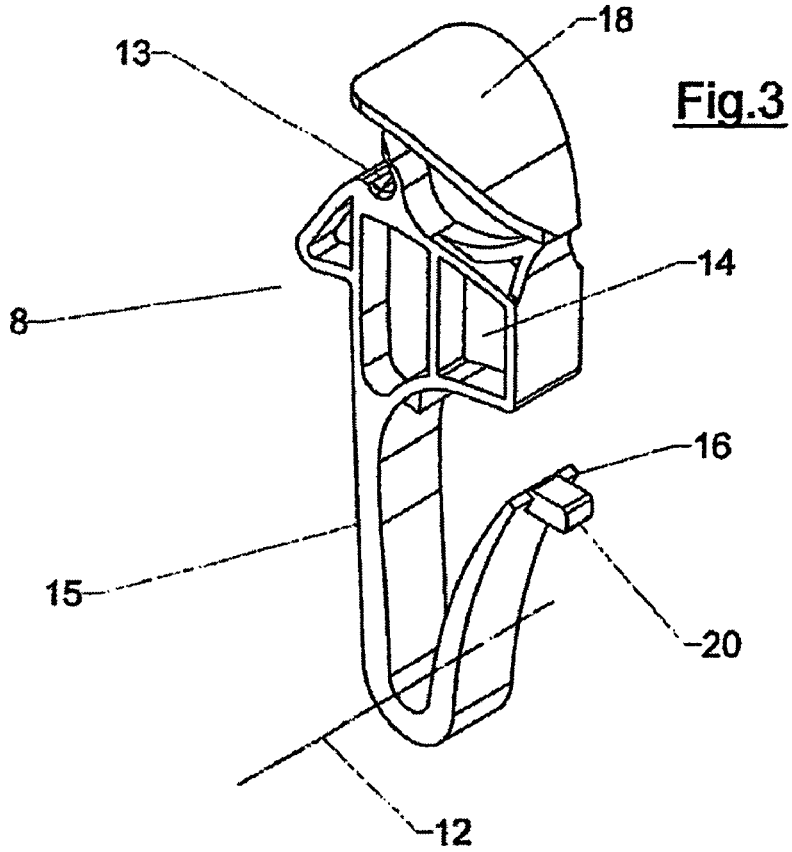
Figure 4:
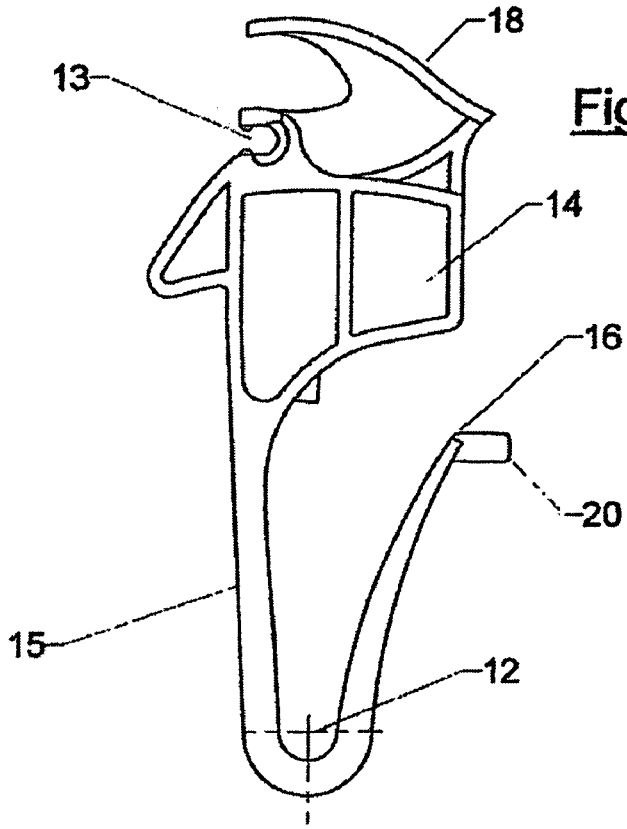
Figure 5:
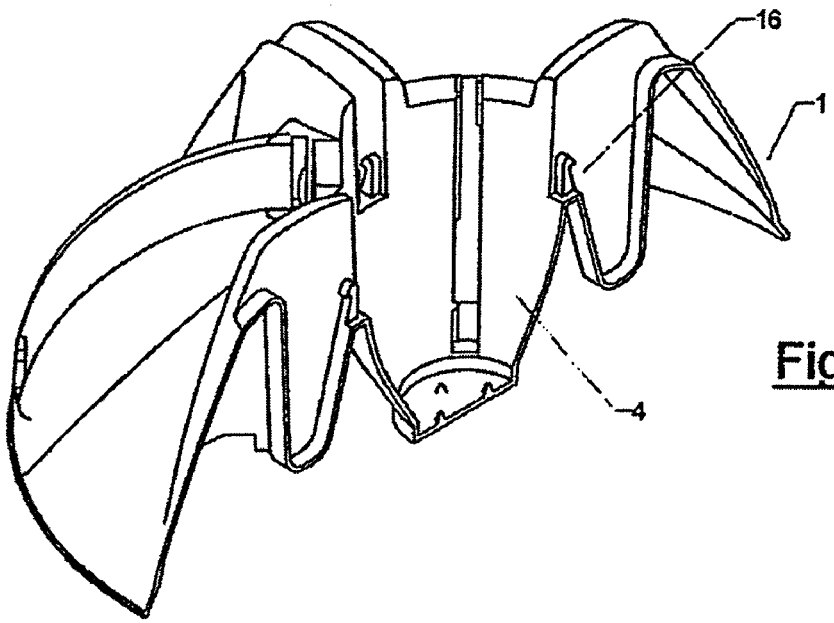
Figure 6:
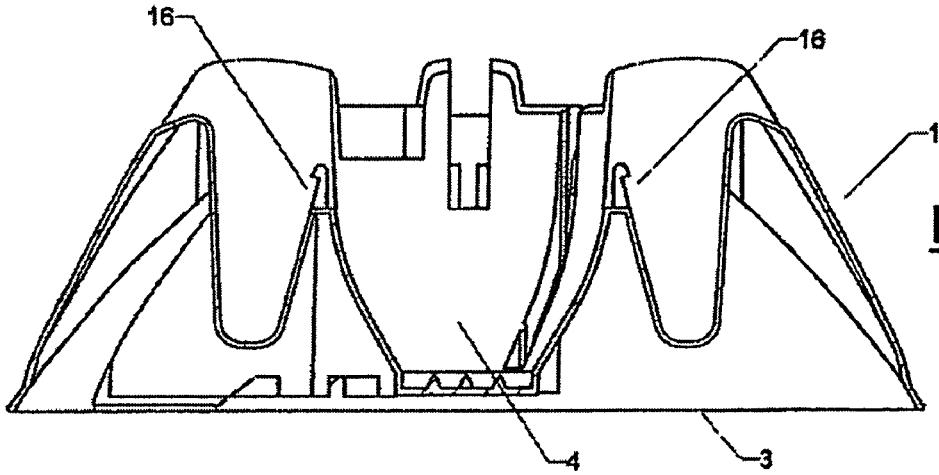
Figure 7:
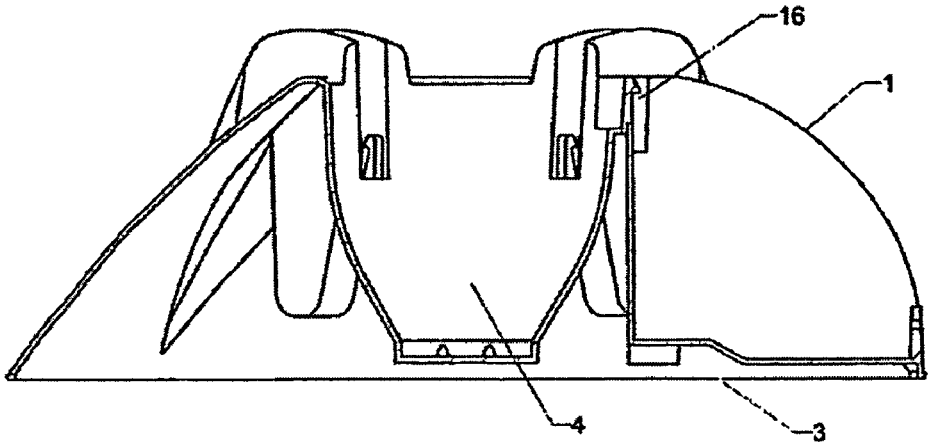
Figure 8:
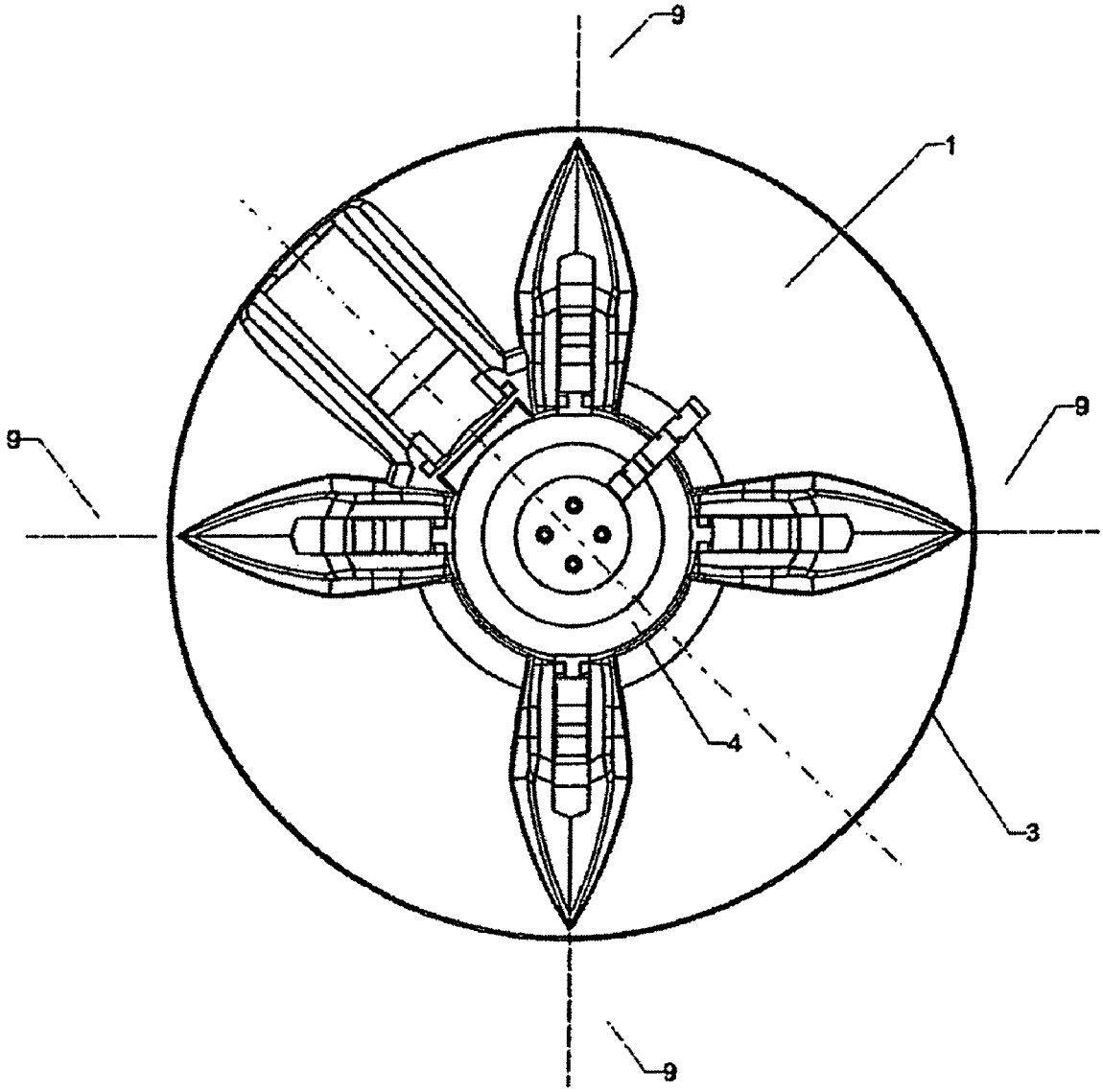

The present invention will now be explained in detail in the following with reference to the exemplary embodiment illustrated in the drawings, of which:

FIG. 1: shows a sectional view of a stand according to the present invention;

FIG. 2: shows another sectional view of a stand according to the present invention;

FIG. 3: shows a perspective view of a holding element according to the present invention;

FIG. 4: shows a lateral view of a holding element according to the present invention;

FIG. 5-7: show different sectional views of the stand according to the present invention; and FIG. 8: shows a plan view of a stand according to the present invention.

FIG. 1 shows the stand 1 for clamping a rod-shaped unit 2, said stand comprising a foot part 3, the seating region 4 for the fixing end 5 of the rod-shaped unit 2 and with holding elements 8. The holding elements 8 are supported in bearing blocks 7 and can move against their own spring force about ideal pivot axes 12 towards the axis of symmetry 6 of the stand in pivoting planes 9 (c.f. FIG. 8), which intersect approximately in the axis of symmetry 6, for clamping the rod-shaped unit 2. The holding elements 8 can move by means of the flexible force transfer element 11 in the form of a steel cable, which is tightened by the tensioning device 10 and which encompasses or penetrates all the holding elements 8 by sliding through the guide openings 13.

For clamping the rod-shaped unit 2, the flexible force transfer element 11 is tightened in the tensioning device 10, which is supported on the stand 1. The tensioning device can be designed in many different ways. Here, only one winding roller construction is shown suggestively, which is driven by a drive wheel, for example, in foot operation, and whose diameter is several times larger than that of the winding roller and which is prevented by a pawl mechanism or a safety catch from inadvertently releasing the clamping action.

The figure shows holding elements 8 which are held in receptacles 17 in bearing blocks 7, wherein the bearing blocks here are not connected to the foot part 3 or designed with it as a single piece, but rather are connected to a surface-mounted part 19 or formed as a single piece with it, which surface-mounted part is in turn fixedly connected to the foot part 3.

The FIG. 1 further shows two holding elements 8 with their dimensionally rigid holding regions 14, the guide openings 13 formed therein for the force transfer element 11 and the guidance surfaces 18 molded on above for facilitating the introduction of the rod-shaped unit 2. FIG. 1 also suggestively shows the resilient element 15 placed or molded on below each dimensionally rigid holding region as a V-shaped upwardly open leaf spring on whose free end catch elements 16 for locking the holding element in place in the receptacle 17 and projections 20 for unlocking the locking mechanism can be seen.

FIG. 2 shows the same stand in another section, which clearly shows the shape and the seat of the holding elements 8 in their respective receptacles 17. This figure shows the compact dimensionally rigid holding regions 14 with guide openings 13, guidance surfaces 18 for facilitating the introduction of the rod-shaped unit 2 and the resilient element 15 molded on the dimensionally rigid holding region 14 as a V-shaped, upwardly open leaf spring whose free leg points towards the axis of symmetry 6 and supports on its free end the catch elements 16 for locking the holding element in place in the receptacle 17 and a projection 20 molded on the free end, by means of which projection the locking mechanism can be unlocked, when the holding element has to be removed or replaced, for example, for cleaning the stand or for the purpose of replacement. This drawing shows particularly how the stand according to the present invention produces the necessary stability without a physical axle bearing of the holding element, namely due to the fact that radially acting forces are absorbed in the receptacle 17 by the resilient element and axially acting forces are absorbed by the guidance surfaces, said guidance surfaces guiding the holding elements laterally.

FIGS. 3 and 4 show in detail the holding element 8 according to the present invention in its design with the resilient element 15 as a V-shaped upwardly open leaf spring including the dimensionally rigid holding region 14, the guidance surface 18 arranged above, the guide opening 13, the resilient element 15 with the catch element 16, said resilient element being molded on to the dimensionally rigid holding region 14, projection 20 and the ideal pivot axis 12 that moves during the pivoting movement.

The figures notably show the advantages of the present invention. This component combines in itself the functions of several components known from the prior art, namely those of pivoted levers, holding claws, pivot axes, return springs and various guidance surfaces and thus already cuts down on considerable, expenditure related to design and installation. In addition, this component can be produced exceedingly inexpensively as a simple molded part, for example as a plastic casting.

This holds true particularly if one considers that this molded part must be designed in a particularly rigid form only in certain locations, namely where the tension forces and holding forces have to be transferred and absorbed and that even a material-saving processing is possible in those locations, for example, in the holding region 14 by using recesses and reinforcements or undercuts. This applies particularly to the supporting lateral guidance of the holding elements by the parallel guidance surfaces on the latter and on the inner surfaces of the receptacles 17 of the associated bearing blocks. Incidentally, the guidance surfaces 18 arranged above the dimensionally rigid holding region can also be designed on the holding region with a material-saving undercut and, for example, with a reinforcing rib.

LIST OF REFERENCE NUMERALS

1 Stand
2 Rod-shaped unit
3 Foot part
4 Seating region
5 Fixing end
6 Axis of symmetry
7 Bearing block
8 Holding elements
9 Pivoting plane
10 Tensioning device
11 Force transfer element
12 Ideal pivot axis
13 Guide openings
14 Dimensionally rigid holding region
15 Resilient element
16 Catch element
17 Receptacle
18 Guidance surface
19 Surface-mounted part
20 Projection

The invention claimed is:

1. A stand for holding a rod-shaped unit, particularly a Christmas tree, said stand comprising a foot part, a seating region for the fixing end of the rod-shaped unit, said seating region being located on the foot part, with several holding elements, arranged in bearing blocks located around an axis of symmetry of the stand and which are each pivotable against spring force in a pivoting plane out of an open position into a holding position, said pivoting planes intersecting approximately in the axis of symmetry and with at least one flexible force transfer element, which can be loaded in tension and can be actuated by means of a tensioning device and which engages around the holding elements by being guided in a sliding manner above their pivot axes in guide openings of the holding elements and which when tightened causes the holding elements to pivot towards the axis of symmetry, where the holding elements include a resilient portion positioned below a dimensionally rigid holding region, each holding element being supported in a respective bearing block by the resilient portion, wherein the resilient portion is designed in such a way in the bearing block that the holding element is pivotable out of the open position into the holding position, and is guided in this pivoting movement in the bearing block while pivoting about a pivot axis and simultaneously providing a spring force counteracting the pivoting movement.

2. The stand according to claim 1, wherein the resilient portion is designed and supported in the bearing block in such a way that the holding element is pivotable about a moving pivot axis during its pivoting movement.

3. The stand according to claim 1, wherein in the resilient elements are designed as a V-shaped upwardly opening leaf spring, having one leg attached to the dimensionally rigid holding region.

4. The stand according to claim 1, wherein the resilient portion and the dimensionally rigid holding regions comprise a one piece structure.

5. The stand according to claim 1, wherein the resilient element is designed as a carrier of substantially constant bending stress.

6. The stand according to claim 1, wherein the holding elements are designed such that they can be locked into position in the respective bearing block by means of catch elements.

7. The stand according to claim 6, wherein the catch elements are located on the free end of the resilient portion.

8. The stand according to claim 6, wherein the catch elements are each designed as trailing cams on a free end of a free leg of a V-shaped resilient element (15).

9. The stand according to claim 1, further including guidance surfaces, for guiding the pivoting movement of the holding element, are provided on the holding elements and on the bearing blocks, said guidance surfaces corresponding to one another and being parallel to the pivoting plane of the respective holding element.

10. The stand according to claim 1, wherein the bearing blocks are molded on to the foot part of the stand or a surface-mounted part connected to the foot part, thus forming a single piece with said foot part or surface-mounted part.

11. The stand according to claim 1, wherein the holding elements comprise, above the dimensionally rigid holding regions, guidance surfaces inclined downwardly towards the axis of symmetry of the stand for facilitating the introduction of the rod-shaped unit.

12. The stand according to claim 1, wherein at least one force transfer element can be tightened by means of a foot operable tensioning device.

* * * * *